US007423231B2

(12) United States Patent
Brown

(10) Patent No.: US 7,423,231 B2
(45) Date of Patent: Sep. 9, 2008

(54) ORGANIZING A PLURALITY OF ITEMS INTO A DELIVERY POINT SEQUENCE

(75) Inventor: John W. Brown, Manassas, VA (US)

(73) Assignee: United States Postal Service, Washington, DC (US)

( * ) Notice: Subject to any disclaimer, the term of this patent is extended or adjusted under 35 U.S.C. 154(b) by 0 days.

(21) Appl. No.: 10/450,296

(22) PCT Filed: Dec. 13, 2001

(86) PCT No.: PCT/US01/47946

§ 371 (c)(1),
(2), (4) Date: Jun. 13, 2003

(87) PCT Pub. No.: WO02/48832

PCT Pub. Date: Jun. 20, 2002

(65) Prior Publication Data

US 2004/0035762 A1 Feb. 26, 2004

Related U.S. Application Data

(60) Provisional application No. 60/255,144, filed on Dec. 14, 2000.

(51) Int. Cl.
*B07C 5/00* (2006.01)

(52) U.S. Cl. ..... 209/584; 209/900

(58) Field of Classification Search ..... 209/583, 209/584, 900; 235/375, 379, 380, 381, 382
See application file for complete search history.

(56) References Cited

U.S. PATENT DOCUMENTS 4,985,842 A 1/1991 Ward
5,009,321 A * 4/1991 Keough ..... 209/3.1
5,042,667 A * 8/1991 Keough ..... 209/3.1
5,097,959 A * 3/1992 Tilles et al. ..... 209/584
5,363,971 A 11/1994 Weeks et al.
5,901,855 A * 5/1999 Uno et al. ..... 209/584
5,924,576 A * 7/1999 Steenge ..... 209/584
6,241,099 B1 * 6/2001 Hendrickson et al. ..... 209/542
6,274,836 B1 8/2001 Walach
6,303,889 B1 * 10/2001 Hayduchok et al. ..... 209/584
6,316,741 B1 * 11/2001 Fitzgibbons et al. ..... 209/584
6,576,857 B1 * 6/2003 De Leo et al. ..... 209/584
6,598,748 B2 * 7/2003 Mileaf et al. ..... 209/542
6,685,030 B1 * 2/2004 Mileaf ..... 209/542
6,732,012 B2 * 5/2004 Hendrickson et al. ..... 700/224

* cited by examiner

*Primary Examiner*—Patrick Mackey
*Assistant Examiner*—Mark Hageman
(74) *Attorney, Agent, or Firm*—Finnegan Henderson Farabow Garrett & Dunner LLP

(57) ABSTRACT

A method and system for providing delivery point sequencing consistent with the invention includes assigning the plurality of items dynamic sequence numbers as the plurality of items pass through a sequencing component a first time, the sequencing component component comprising a plurality of partitions. Next the method and system include sorting the plurality of items into the plurality of partitions of the sequencing component as the plurality of items pass through the sequencing component the first time, each partition having a corresponding batch of items. And finally the method and system include sorting the items of each batch by the dynamic sequence numbers as the plurality of items pass through the sequencing component a second time, each of the plurality of partitions sorting only items of its corresponding batch.

24 Claims, 5 Drawing Sheets

ORGANIZING A PLURALITY OF ITEMS INTO A DELIVERY POINT SEQUENCE

RELATED APPLICATION

Under provisions of 35 U.S.C. § 119(e), the Applicant claims the benefit of U.S. provisional application No. 60/255,144 filed Dec. 14, 2000, which is incorporated herein by reference.

TECHNICAL FIELD

The present invention relates to the field of organizing items. More particularly, the present invention, in various specific embodiments, involves methods and systems directed to organizing a plurality of items into a delivery point sequence.

BACKGROUND

With the advent and steady growth of electronic mail and electronic commerce for messages and ordering, traditional mail, that is, the physical mail stream, will increasingly be utilized for sending and receiving packages and other types of mail pieces. In an effort to lower operating costs and increase value for their customer base, many high-volume delivery system operators sort items with automated equipment. Delivery system operators realize a cost savings by organizing a plurality of items into a delivery point sequence. For example, organizing a plurality of items into a delivery point sequence allows a delivery system operator to merely take the organized plurality of items and deliver the items in a sequence corresponding to a particular route.

Therefore, there is a need for delivery system operators, such as the United States Postal Service (USPS) and other organizations, to better organize items. More specifically, delivery system operators desire to efficiently organize a plurality of items into a delivery point sequence. This is because in an increasingly competitive environment, it is essential for a delivery system operator to reduce costs and exceed the expectations of those who receive a service. Efficiently providing item organization remains an elusive goal. Thus, there remains a need for efficiently providing item organization in an item delivery system. In addition, there remains a need for efficiently organizing a plurality of items into a delivery point sequence.

SUMMARY OF THE INVENTION

In one aspect, a method for organizing a plurality of items into a delivery point sequence includes passing the plurality of items through a sequencing component a first time wherein the sequencing component assigns the plurality of items dynamic sequence numbers, and sorting the plurality of items by the dynamic sequence numbers as the plurality of items pass through the sequencing component a second time.

In another aspect, a method for organizing a plurality of items into a delivery point sequence includes assigning the plurality of items dynamic sequence numbers as the plurality of items pass through a sequencing component a first time, the sequencing component comprising a plurality of partitions, sorting the plurality of items into the plurality of partitions of the sequencing component as the plurality of items pass through the sequencing component the first time, each partition having a corresponding batch of items, and sorting the items of each batch by the dynamic sequence numbers as the plurality of items pass through the sequencing component a second time, each of the plurality of partitions sorting only items of its corresponding batch.

In yet another aspect, a system for organizing a plurality of items into a delivery point sequence includes a component for assigning the plurality of items dynamic sequence numbers as the plurality of items pass through a sequencing component a first time, the sequencing component comprising a plurality of partitions, a sorting component the plurality of items into the plurality of partitions of the sequencing component as the plurality of items pass through the sequencing component the first time, each partition having a corresponding batch of items, and a sorting component the items of each batch by the dynamic sequence numbers as the plurality of items pass through the sequencing component a second time, each of the plurality of partitions sorting only items of its corresponding batch.

Both the foregoing general description and the following detailed description are exemplary and are intended to provide further explanation of the invention as claimed.

BRIEF DESCRIPTION OF THE DRAWINGS

The accompanying drawings provide a further understanding of the invention and, together with the detailed description, explain the principles of the invention. In the drawings.

DETAILED DESCRIPTION

Figure 1:
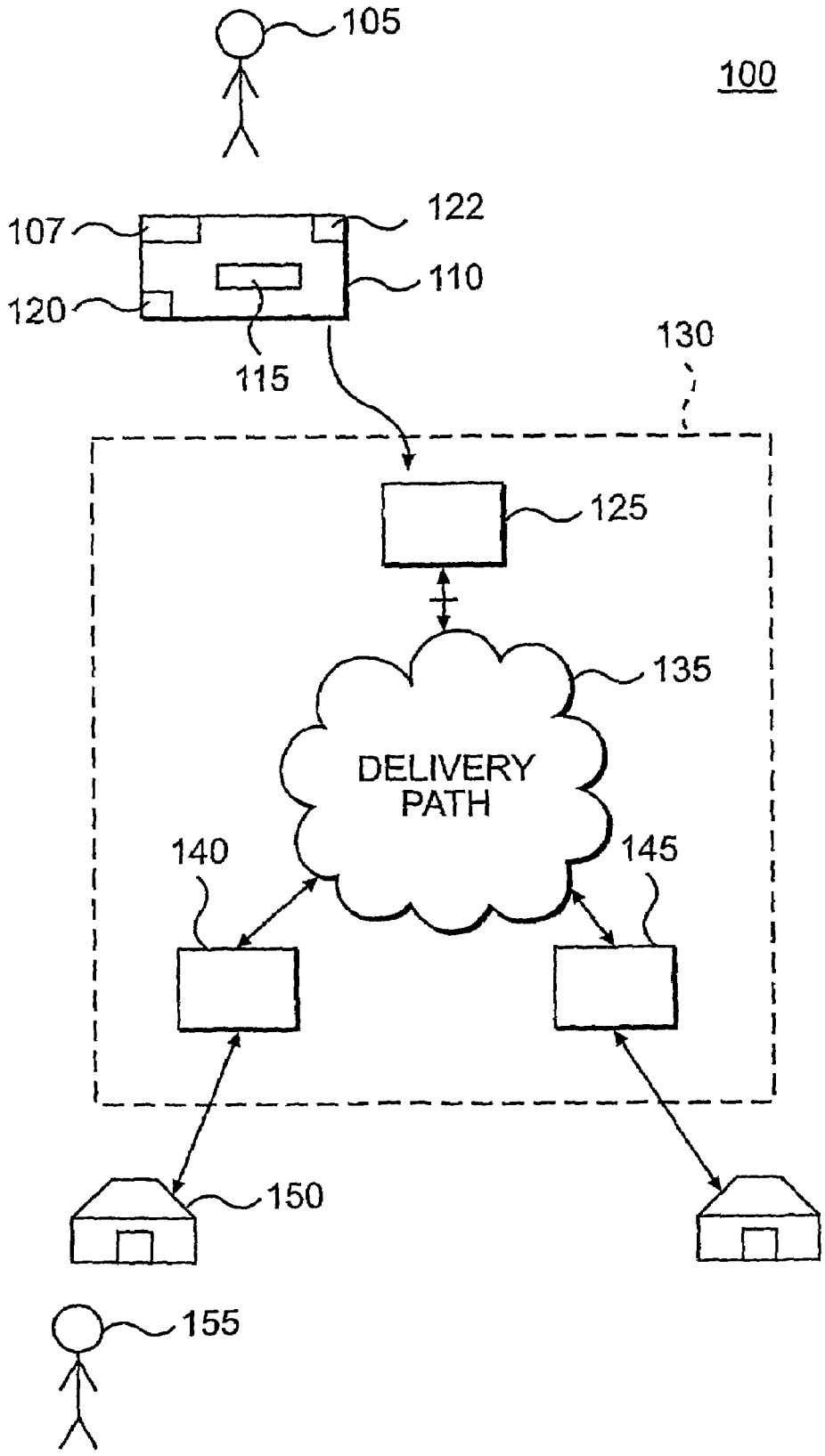
FIG. 1 is a functional block diagram of a system for providing item delivery service consistent with the present invention.

Reference will now be made to various embodiments consistent with this invention, examples of which are shown in the accompanying drawings and will be obvious from the description of the invention. In the drawings, the same reference numbers represent the same or similar elements in the different drawings whenever possible.

Exemplary Item Delivery System

FIG. 1 shows an exemplary item delivery system 100 that may be used in conjunction with the present invention. Within item delivery system 100, for example, an item 110 may be prepared manually by a user 105 or may be prepared utilizing an inserter under the supervision of user 105. An inserter is an automated device capable of assembling item 110 which may comprise a mailpiece, such as a United States Postal Service Express Mail package. While item 110 may comprise any of the aforementioned, those skilled in the art will appreciate that still many other types of items may be utilized.

In exemplary item delivery system 100, materials are placed in item 110 that user 105 wishes to send to a recipient 155. With the materials placed in item 110, an address label 115 is placed on item 110 indicating a first address 150 of a recipient 155 and a return address 107 indicating where to return item 110, if necessary. In addition, a tracking indicia 120 is placed on item 110 along with a delivery payment coding 122. Tracking indicia 120 is utilized by a delivery system operator to facilitate the delivery of item 110. The use of tracking indicia 120 will be discussed in greater detail below. Delivery payment coding 122 indicates the payment amount user 105 believes is required by the delivery system operator to deliver item 110 to recipient 155. Delivery payment coding 122 may comprise a bar code, an image indicating an account from which delivery payment has been made, a postage stamp, or other types of codings as are known by those skilled in the art.

Tracking indicia 120 may comprise a bar code, a PLANET code or other types of indicia as are known by those skilled in the art. A bar code is a printed symbol used for recognition by a bar code scanner (reader). Traditional one-dimensional bar codes use the bar's width to encode a product or account number. Two-dimensional bar codes, such as PDF417, MAXICODE and DATAMATRIX, are scanned horizontally and vertically and hold considerably more data. Generally, PDF417 is widely used for general purposes, MAXICODE is used for high-speed sorting, and DATAMATRIX is used for marking small parts.

Historically, some delivery system operators sorted flat mail using POSTNET, a 12-digit barcode developed by the USPS consisting of alternating long and short bars indicating the destination of, for example, a mailpiece. Responding to the expanding needs of users, particularly heavy volume users, the PLANET code was developed on the foundation of the existing technical infrastructure. The PLANET Code is, in one respect, the opposite of the current POSTNET codes, reversing long bars for short and short bars for long. This innovation offers the convenience of a bar code that is easily applied using current bar-coding methods, and is readily scanned by the high-speed automation equipment already located in the plurality of plants comprising a delivery system 130 as discussed below.

In sending item 110, for example, user 105 places item 110 into a delivery system 130 at a sender plant 125. Item 110 is routed through delivery system 130 comprising sender plant 125, a delivery path 135, a first address plant 140, and a second address plant 145. Delivery path 135 comprises a plurality of plants similar to sender plant 125, first address plant 140, and second address plant 145. The plants within delivery system 130 contain, among other things, automated systems and sorting equipment and are designed to receive and process a plurality of items. Delivery system 130 is configured to sense tracking indicia 120 placed on item 110 as it passes through the elements of delivery system 130 directing the movement of item 110 through delivery system 130. Tracking indicia 120 sensed by delivery system 130 may comprise a bar code, a PLANET code, or other indicia as described herein above.

In the delivery process, item 110 is routed to the next most appropriate plant in delivery system 130. The appropriateness of the next plant in delivery system 130 depends upon the present location of the particular item in delivery system 130 and where item 110 is addressed. Ultimately, item 110 is routed in delivery system 135 to the plant that serves the delivery address indicated on item 110, according to established procedures. Thus, item 110 is routed from plant to plant within delivery system 130 wherein item 110 efficiently converges on the plant that serves the delivery address indicated on the item, in this case, first address plant 140. Throughout this process, delivery system 130 tracks the progress of items 110 through delivery system 130.

System for Organizing a Plurality of Items

Consistent with the general principles of the present invention, a system for organizing a plurality of items into a delivery point sequence comprises a component for assigning the plurality of items dynamic sequence numbers as the plurality of items pass through a sequencing component a first time, the sequencing component comprising a plurality of partitions. In addition, the system comprises a sorting component the plurality of items into the plurality of partitions of the sequencing component as the plurality of items pass through the sequencing component the first time, each partition having a corresponding batch of items. And finally, the system comprises a sorting component the items of each batch by the dynamic sequence numbers as the plurality of items pass through the sequencing component a second time, each of the plurality of partitions sorting only items of its corresponding batch.

Figure 2:
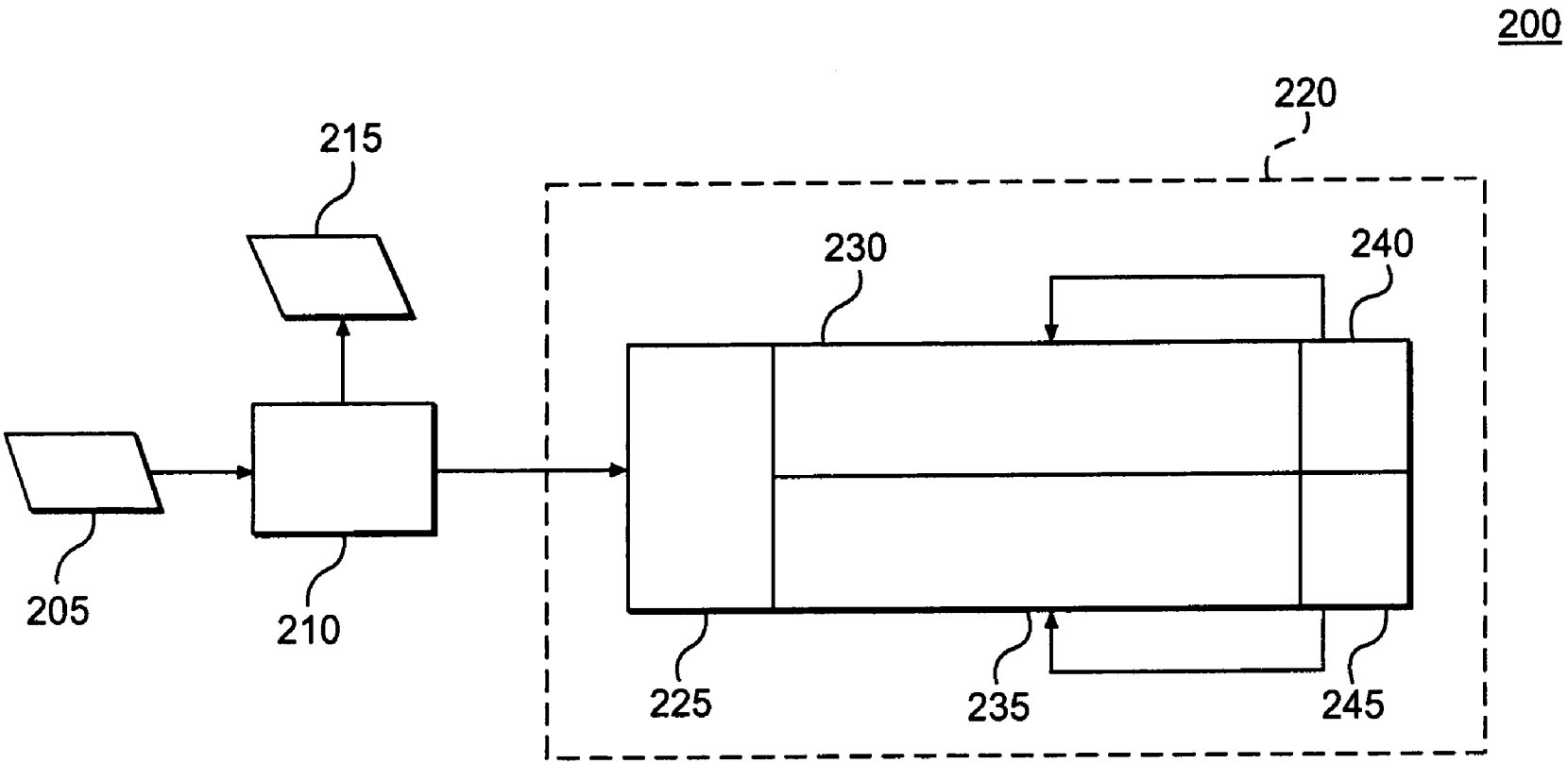
FIG. 2 is a functional block diagram of a system for organizing a plurality of items into a delivery point sequence consistent with the present invention.

As herein embodied and illustrated in FIG. 2, an organizing system 200 comprises a plurality of items 205, a sorting component 210, excluded items 215, and a sequencing component 220. In the exemplary embodiment of FIG. 2, the component for assigning the plurality of items dynamic sequence numbers, the sorting component the plurality of items into the plurality of partitions, and the sorting component the items of each batch by the dynamic sequence numbers may all be embodied in sequencing component 220.

Items 205 may comprise flat mail, catalogs, magazines, mailpieces, and United States Postal Service Express Mail Packages. In addition, items 205 may be configured and labeled in a similar manner to item 110, as described above with respect to FIG. 1. Those skilled in the art will appreciate that items 205 may comprise other types of items and may be configured or labeled in other manners.

Sorting component 210 may comprise automated systems and high-speed automated sorting equipment containing, for example, image capturing systems such as digital video cameras. Sorting component 210 may be controlled by a personal computer or other similar microcomputer-based workstation. Those skilled in the art, however, will appreciate that sorting component 210 may be controlled by other types of computerized devices, such as hand-held devices, multiprocessor systems, microprocessor-based or programmable consumer electronics, minicomputers, mainframe computers, and the like. Sorting component 210 may also be practiced in distributed computing environments where tasks are performed by remote processing devices and may have the capability of connecting to a communications system. The communications system may comprise a wire line communications system, a wire line network, a wireless communications system, or a wireless network. "Wireless" can be defined as radio transmission via the airwaves, however, those skilled in the art will appreciate that various other communication techniques can be used to provide wireless transmission including infrared line of sight, cellular, microwave, satellite, packet radio, and spread spectrum radio.

Sequencing component 220 may comprise a component for assigning the plurality of items dynamic sequence numbers 225, a first partition 230, a second partition 235, a first partition batch 240, and a second partition batch 245. Similar to sorting component 210, sequencing component 220 may comprise automated systems and high-speed automated sorting equipment containing, for example, image capturing systems such as digital video cameras. Sequencing component 220 may also be controlled by a personal computer or other similar microcomputer-based workstation. Those skilled in the art, however, will appreciate that sequencing component 220 may be controlled by other types of computerized devices, such as hand-held devices, multiprocessor systems, microprocessor-based or programmable consumer electronics, minicomputers, mainframe computers, and the like. Sequencing component 220 may also be practiced in distributed computing environments where tasks are performed by remote processing devices and may have the capability of connecting to a communications system. The communications system may comprise a wire line communications system, a wire line network, a wireless communications system, or a wireless network.

Sequencing component 220, for example, may be configured to accept plurality of items 205, and scan information from individual items contained within items 205. Based on the information scanned from such individual items, sequencing component 220 may be further configured to route the individual items through partitions of sequencing component 220 such as first partition 230 and second partition 235. Once processed through the partitions of sequencing component 220, items 205 are segregated into batches such as first partition batch 240 and second partition batch 245. In addition, sequencing component 220 may be further configured to perform other processes and sort individual items contained in the batches by re-feeding the individual items contained in the batches through the partitions that produced them.

Method for Organizing a Plurality of Items

Figure 3:
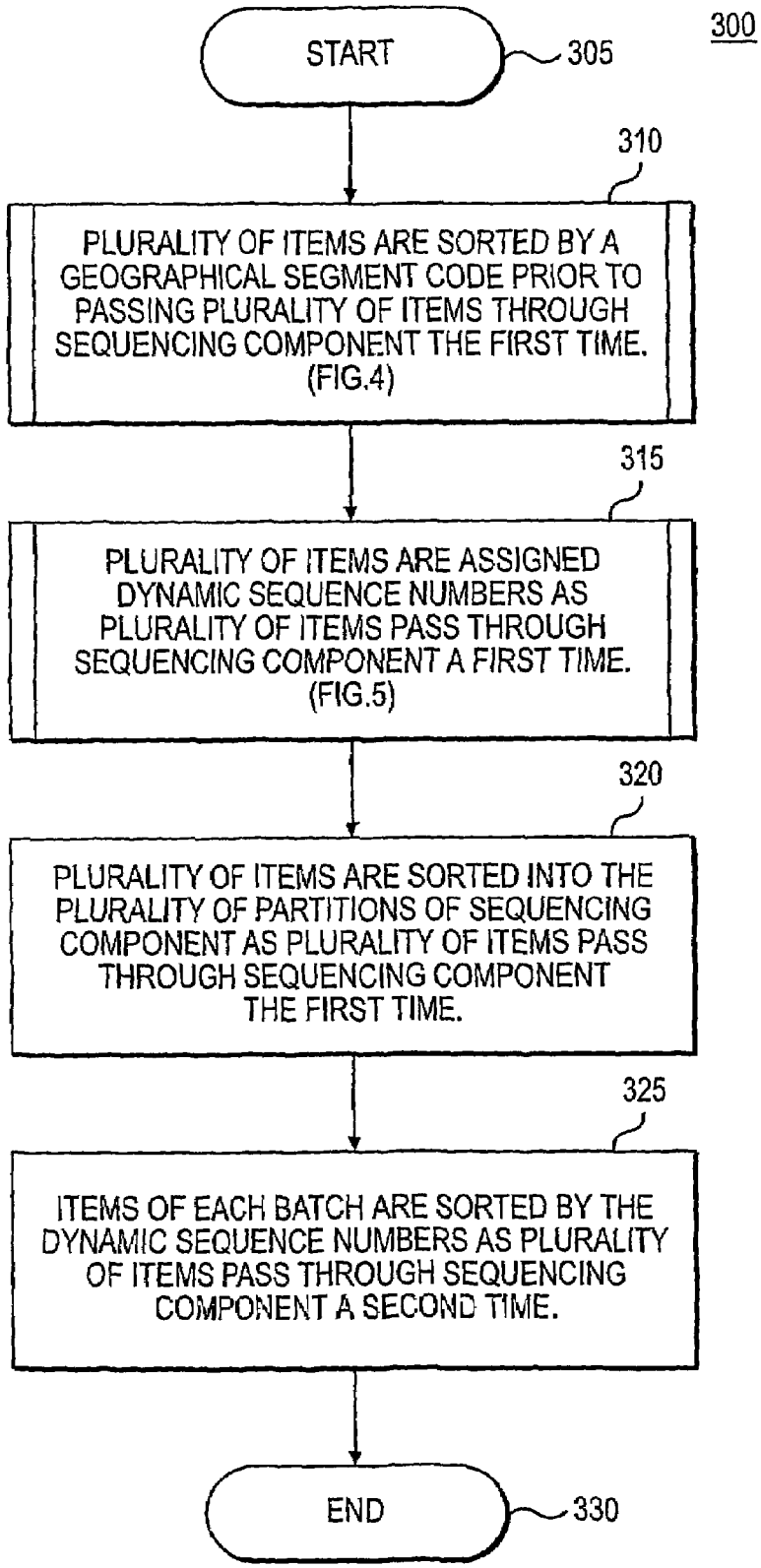
FIG. 3 is a flow chart of an exemplary method for organizing a plurality of items into a delivery point sequence consistent with the present invention.
Figure 4:
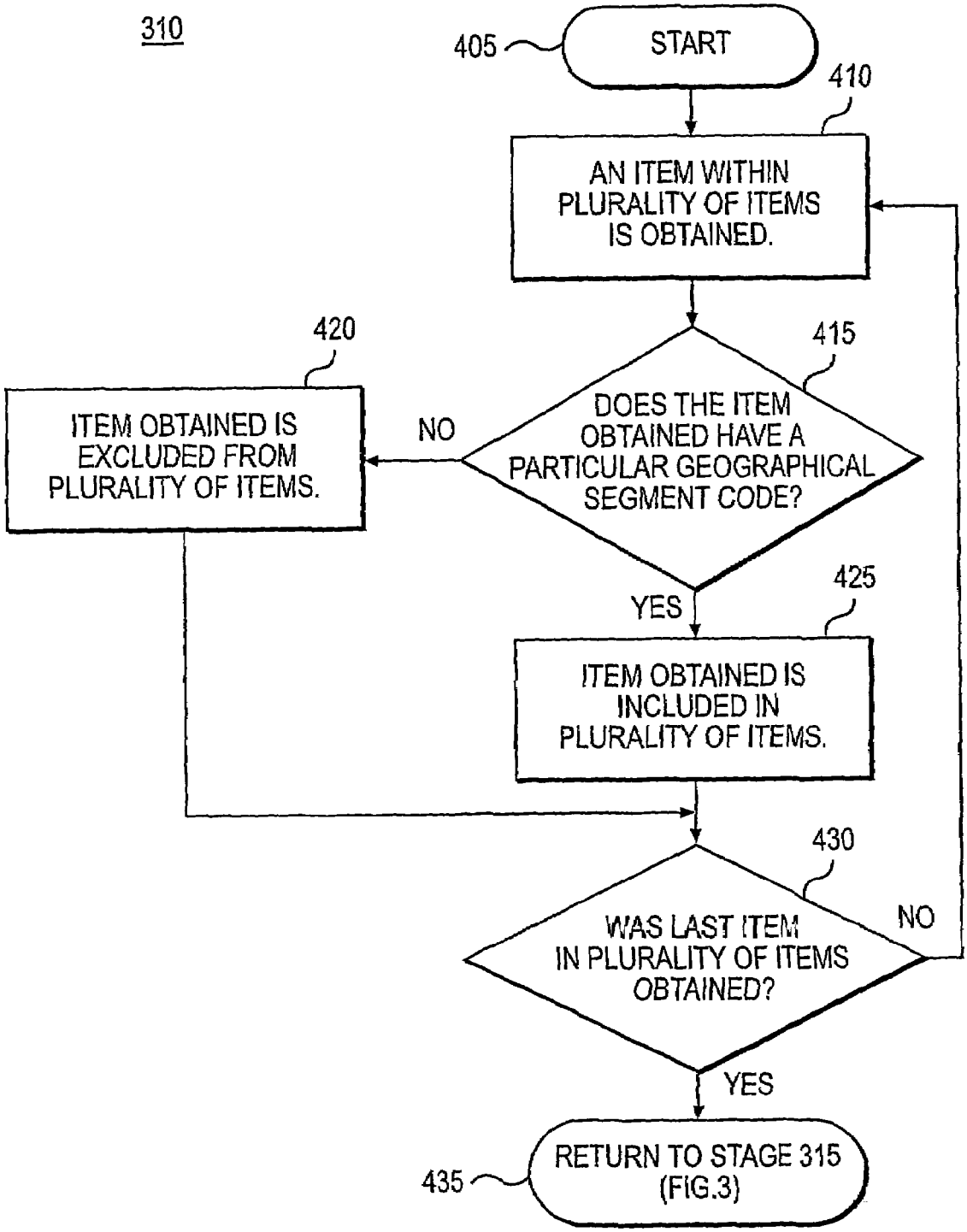
FIG. 4 is a flow chart of an exemplary subroutine used in the exemplary method of FIG. 3 for sorting by a geographical segment code prior to passing a plurality of items through a sequencing component a first time.

FIG. 3 is a flow chart setting forth the general stages involved in an exemplary method 300 for organizing a plurality of items into a delivery sequence. Exemplary method 300 begins at starting block 305 and proceeds to exemplary subroutine 310 where items 205 are sorted by a geographical segment code prior to passing through sequencing component 220 the first time. The stages of subroutine 310 are shown in FIG. 4 and will be discussed in greater detail below.

Figure 5:
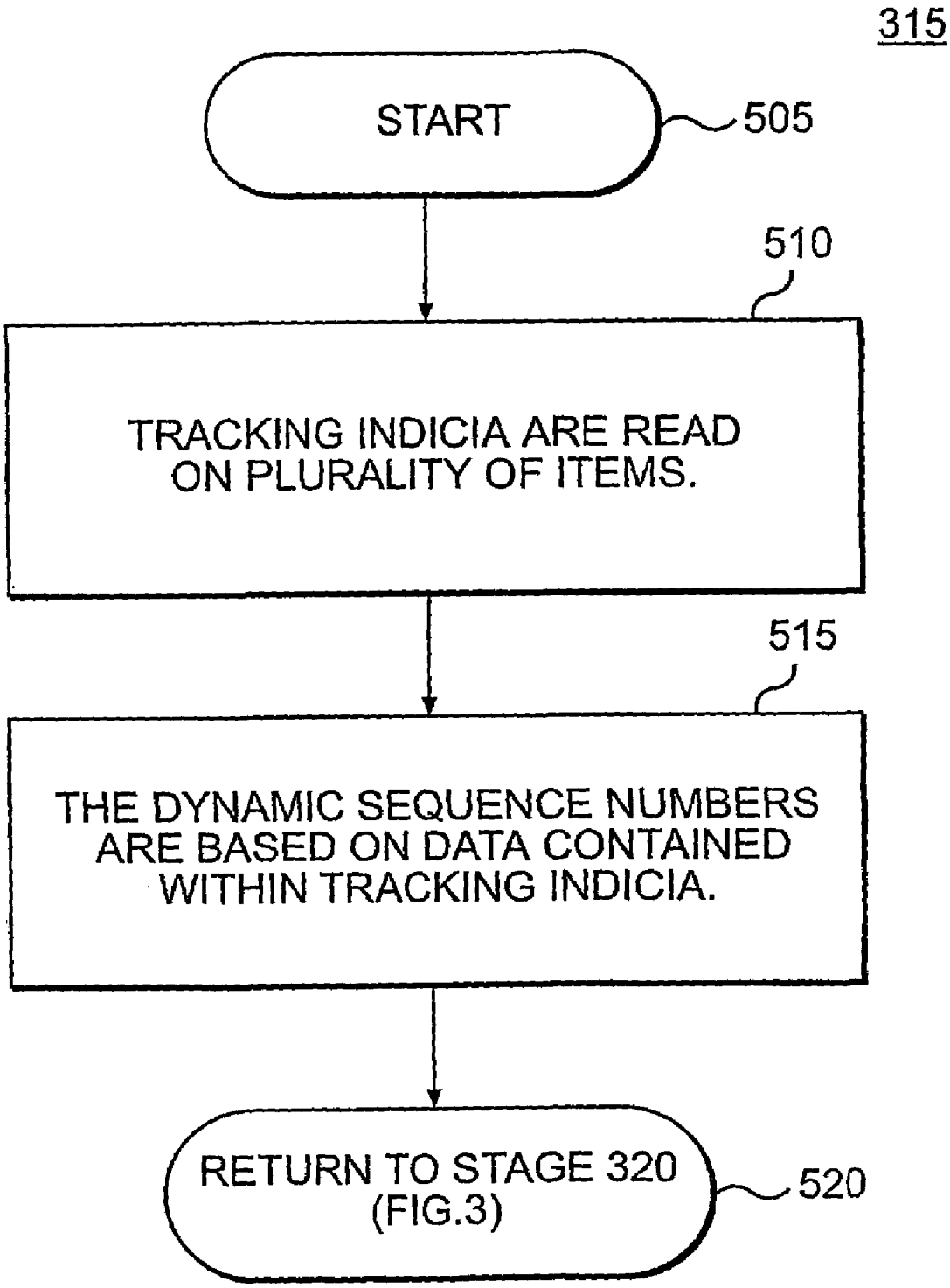
FIG. 5 is a flow chart of an exemplary subroutine used in the exemplary method of FIG. 3 for assigning a plurality of items dynamic sequence numbers as the plurality of items pass through the sequencing component the first time.

From subroutine 310, method 300 advances to exemplary subroutine 315 where 205 are assigned dynamic sequence numbers as they pass through sequencing component 220 a first time. The stages of subroutine 315 are shown in FIG. 5 and will be discussed in greater detail below.

After items 205 are assigned dynamic sequence numbers in subroutine 315, method 300 continues to stage 320 where items 205 are sorted into the plurality of partitions of sequencing component 220 as they pass through sequencing component 220 the first time. Each partition may correspond to a route within a delivery system.

For example, first partition 230 may correspond to a first route within item delivery system 100 and second partition 235 may correspond to a second route within item delivery system 100. When items 205 are sorted into the plurality of partitions, organizing system 200 may, for example, read the dynamic sequence number of an individual item. Based on the dynamic sequence number read, organizing system 200 may then route the item to the partition corresponding to the route that contains the delivery point for the item. Thus, if the delivery point for the item is contained in the route corresponding to first partition 230, organizing system 200 routes the item to first partition 230.

The size of the partitions may vary based upon historical data, volume of items in each of the plurality of batches, and the time it would take a delivery system operator to deliver the items in the batch corresponding to the partition. For example, if the route corresponding to first partition 230 is historically larger than the route corresponding to second partition 235, first partition 230 may be physically larger than second partition 235. Similarly, the partitions may be adjusted dynamically as the volume of items are processed during the operation of organizing system 200.

Once items 205 are sorted in stage 320, method 300 advances to stage 325 where items of each batch are sorted by the dynamic sequence numbers as items 205 pass through sequencing component 220 a second time. For example, during this second pass, each partition processes only the items that passed through the partition during the first pass. In performing this second pass, the items are routed from the batches and back through their corresponding partition. For example, items of first partition batch 240 will be processed by first partition 230 and items of second partition batch 245 will be processed by second partition 235.

In sorting the items by dynamic sequence numbers, the items are arranged substantially in the order by which they are to be delivered. For example, for a given route with 100 delivery points, the item with dynamic sequence number 1 is at the beginning of the route, while the item with dynamic sequence number 100 corresponds to the delivery point that is last on the route. The delivery sequence within a route may be arranged to economize time and effort in delivering the items.

From stage 325, method 300 ends at stage 330.

Sorting by a Geographical Segment Code

FIG. 4 is a flow chart setting forth the general stages involved in subroutine 310 for sorting by a geographical segment code prior to passing items 205 through sequencing component 220 the first time. Subroutine 310 begins at starting block 405 and proceeds to stage 410 where an item within plurality of items 205 is selected at random from items 205.

Once an item 205 is selected, subroutine 310 continues to decision block 415 where it is determined if the selected item has a particular geographical segment code. The particular geographical segment code may be predetermined by the operator of organizing system 200 for the particular operation to be performed by organizing system 200. The geographical segment code on the selected item may be obtained by scanning the tracking indicia on the selected item or by scanning the address label with a digital camera or other type of scanning device. If the address label is scanned, character recognition software may be employed to extract a geographical segment code data from the scanned image of the address label. The geographical segment code may comprise a United States Postal Service ZIP code, or a United States Postal Service ZIP+4 code. Those skilled in the art will appreciate that the geographical segment code may comprise may other types of codings, markings, printings or labels.

If it is determined at decision block 415 that selected item does not have a particular geographical segment code, exemplary subroutine 310 advances to stage 420 where selected item is excluded from plurality of items 205. In this case, the item may be routed within organizing system 200 to a holding area (not shown) and held there for further processing. The selected item may be excluded from plurality of items 205 because the selected item may not correspond to a delivery point contained in the geographic area for which the present organizing system 200 operation is being performed.

However, if it was determined at decision block 415 that the selected item does have a particular geographical segment code, subroutine 310 advances to stage 425 where the selected item obtained is included in plurality of items 205 because the item obtained may correspond to a delivery point contained in the geographic area for which the present organizing system 200 operation is being performed.

From stage 420, or stage 425, subroutine 310 continues to decision block 430 where it is determined if the selected item was the last item in plurality of items 205. If at decision block 430 it is determined that the selected item was not the last item, subroutine 310 continues to stage 410 and repeats the stages of subroutine 310. Each item within plurality of items 205 may be checked during this process. If at decision block 430, however, it is determined that the item obtained was the last item in plurality of items, subroutine 310 advances to stage 435 and returns to stage 315 of FIG. 3.

Assigning Dynamic Sequence Numbers

FIG. 5 is a flow chart setting forth the general stages involved in an exemplary subroutine 315 for assigning plurality of items 205 dynamic sequence numbers of items 205 pass through sequencing component 220 a first time. Subroutine 315 begins at starting block 505 and proceeds to stage 510 where tracking indicia are read on plurality of items. The tracking indicia may comprise a bar code or a PLANET code; however, tracking indicia may comprise other types of codings as are known by those skilled in the art.

Once tracking indicia are read, subroutine 315 advances to stage 515 where dynamic sequence numbers are created, based on data contained within tracking indicia. The dynamic sequence numbers may indicate the order in which items within the plurality of items 205 are to be delivered within a route. With the data obtained from the tracking indicia, a database may be queried in order to determine the dynamic sequence number that corresponds to the item. While the tracking indicia is used in this embodiment to provide data used to determine a dynamic sequence number, those skilled in the art will appreciate that other means, processes, labels, codings, or printings other than the tracking indicia may be employed to obtain the same or substantially similar information. From stage 515, subroutine 315 advances to stage 520 and returns to stage 320 of FIG. 3.

It will be appreciated that a system in accordance with an embodiment of the invention can be constructed in whole or in part from special purpose hardware or a general purpose computer system, or any combination thereof. Any portion of such a system may be controlled by a suitable program. Any program may in whole or in part comprise part of or be stored on the system in a conventional manner, or it may in whole or in part be provided in to the system over a network or other mechanism for transferring information in a conventional manner. In addition, it will be appreciated that the system may be operated and/or otherwise controlled by means of information provided by an operator using operator input elements (not shown) which may be connected directly to the system or which may transfer the information to the system over a network or other mechanism for transferring information in a conventional manner.

The foregoing description has been limited to a specific embodiment of this invention. It will be apparent, however, that various variations and modifications may be made to the invention, with the attainment of some or all of the advantages of the invention. It is the object of the appended claims to cover these and such other variations and modifications as come within the true spirit and scope of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A method for organizing a plurality of items into a delivery point sequence comprising:

sorting the plurality of items by a geographical segment code prior to passing the plurality of items through a sequencing component, the sequencing component comprising a plurality of partitions, Determining a maximum capacity of an individual partition based upon either historical data of the geographical segment code or a time predicted in will take to deliver the items in the batch corresponding to the individual partition;

Dynamically adjusting a size of the individual partition as the plurality of items are passed through the sequencing component;

passing the plurality of items through the sequencing component a first time wherein the sequencing component assigns dynamic sequence numbers to the plurality of items; and sorting the plurality of items by the dynamic sequence numbers as the plurality of items pass through the sequencing component a second time.

2. The method of claim 1, wherein items within the plurality of items that do not have a specified geographical segment code are excluded from the plurality of items.

3. The method of claim 1, wherein the geographical segment code comprises at least one of the following: a United States Postal Service ZIP code, and a United States Postal Service ZIP+4 code.

4. The method of claim 1, wherein items within the plurality of items comprise at least one of the following: flat mail, catalogs, magazines, mailpieces, and United States Postal Service Express Mail Packages.

5. The method of claim 1, wherein the dynamic sequence numbers indicate the order in which items within the plurality of items are to be delivered within a route.

6. The method of claim 1, wherein the sequencing component assigns the plurality of items the dynamic sequence numbers by reading tracking indicia on the plurality of items and basing the dynamic sequence numbers on data indicated by the tracking indicia.

7. The method of claim 6, wherein the tracking indicia comprises at least one of the following: a bar code and a PLANET code.

8. A method for organizing a plurality of items into a delivery point sequence comprising:

sorting the plurality of items by a geographical segment code prior to passing the plurality of items through a sequencing component;

assigning dynamic sequence numbers to the plurality of items as the plurality of items pass through the sequencing component a first time, the sequencing component comprising a plurality of partitions;

sorting the items into the plurality of partitions of the sequencing component as the plurality of items pass through the sequencing component the first time, each partition having a corresponding batch of the items; and sorting the items of each batch by the dynamic sequence numbers as the items pass through the sequencing component a second time, each of the plurality of partitions sorting only items of its corresponding batch, Determining a maximum capacity of an individual partition based upon either historical data of the geographical segment code or a time predicted in will take to deliver the items in the batch corresponding to the individual partition;

Dynamically adjusting a size of the individual partition as the plurality of items are passed through the sequencing component.

9. The method of claim 8, wherein each partition corresponds to a route within a delivery system.

10. The method of claim 8, wherein sorting the plurality of items by a geographical segment code comprises:

identifying items within the plurality of items that do not have a specified geographical segment code; and excluding the identified items from the plurality of items.

11. The method of claim 10, wherein the geographical segment code comprises at least one of the following: a United States Postal Service ZIP code, and a United States Postal Service ZIP+4 code.

12. The method of claim 8, wherein assigning the plurality of items dynamic sequence numbers further comprises:

reading tracking indicia on the plurality of items; and basing the dynamic sequence numbers on data indicated by the tracking indicia.

13. The method of claim 12, wherein the tracking indicia comprises at least one of the following: a bar code and a PLANET code.

14. The method of claim 8, wherein items within the plurality of items comprise at least one of the following: flat mail, catalogs, magazines, mailpieces, and United States Postal Service Express Mail Packages.

15. The method of claim 8, wherein the dynamic sequence numbers indicate the order in which items within the plurality of items are to be delivered within a route.

16. A system for organizing a plurality of items into a delivery point sequence comprising:

a sorting component that sorts the plurality of items by a geographical segment code prior to passing the plurality of items through a sequencing component, the sequencing component comprising a plurality of partitions;

A component for determining a maximum capacity of an individual partition based upon either historical data of the geographical segment code or a time predicted in will take to deliver the items in the batch corresponding to the individual partition;

A component that dynamically adjusts a size of the individual partition as the plurality of items are passed through the sequencing component;

a component for assigning dynamic sequence numbers to the items as the plurality of items pass through the sequencing component a first time;

a sorting component that sorts the plurality of items into the plurality of partitions as the items pass through the sequencing component the first time, each partition having a corresponding batch of items; and a sorting component that sorts the items of each batch by the dynamic sequence numbers as the items pass through the sequencing component a second time, each of the plurality of partitions sorting only items of its corresponding batch.

17. The system of claim 16, wherein each partition corresponds to a route within a delivery system.

18. The system of claim 16, wherein items within the plurality of items that do not have a specified geographical segment code are excluded from the plurality of items.

19. The system of claim 16, wherein the geographical segment code comprises at least one of the following: a United States Postal Service ZIP code, and a United States Postal Service ZIP+4 code.

20. The system of claim 16, wherein the component for assigning the plurality of items dynamic sequence numbers further comprises:

a component for reading tracking indicia on the plurality of items; and a component for basing the dynamic sequence numbers on data indicated by the tracking indicia.

21. The system of claim 20, wherein the tracking indicia comprises at least one of the following: a bar code and a PLANET code.

22. The system of claim 16, wherein items within the plurality of items comprise at least one of the following: flat mail, catalogs, magazines, mailpieces, and United States Postal Service Express Mail Packages.

23. The system of claim 16, wherein the dynamic sequence numbers indicate the order in which items within the plurality of items are to be delivered within a route.

24. A method for organizing a plurality of items into a delivery point sequence comprising:

sorting the plurality of items by a geographical segment code, wherein items within the plurality of items that do not have a specified geographical segment code are excluded from the plurality of items, the geographical segment code comprising at least one of the following: a United States Postal Service ZIP code, and a United States Postal Service ZIP+4 code, items within the plurality of items comprising at least one of the following: flat mail, catalogs, magazines, mailpieces, and United States Postal Service Express Mail Packages;

assigning sequence numbers to the plurality of items as the plurality of items pass through a sequencing component a first time, wherein tracking indicia are read from the plurality of items and the sequence numbers are based on data indicated by the tracking indicia, the tracking indicia comprising at least one of the following: a bar code and a PLANET code, the sequence numbers indicating the order in which items within the plurality of items are to be delivered within a route, wherein the sequencing component comprises a plurality of partitions;

Determining a maximum capacity of each partition based upon either historical data of the geographical segment code or a time predicted in will take to deliver the items in the batch corresponding to each partition;

Dynamically adjusting a size of each partition as the plurality of items are passed through the sequencing component; and sorting the items of each batch by the sequence numbers as the plurality of items pass through the sequencing component a second time, each of the plurality of partitions sorting only items of its corresponding batch.

* * * * *

UNITED STATES PATENT AND TRADEMARK OFFICE

CERTIFICATE OF CORRECTION

PATENT NO. : 7,423,231 B2
APPLICATION NO. : 10/450296
DATED : September 9, 2008
INVENTOR(S) : John W. Brown It is certified that error appears in the above-identified patent and that said Letters Patent is hereby corrected as shown below:

Claim 1, col. 8, line 3, “in will take” should read --it will take--

Claim 8, col. 8, line 58, “in will take” should read --it will take--

Claim 16, col. 9, line 34, “in will take” should read --it will take--

Signed and Sealed this

Fourth Day of November, 2008

JON W. DUDAS
*Director of the United States Patent and Trademark Office*